United States Patent [19]

Rostron

[11] Patent Number: 5,043,617

[45] Date of Patent: Aug. 27, 1991

[54] MULTI-MOTOR LIQUID SAMPLE AND DEVICE

[75] Inventor: Joseph A. Rostron, Wigan, England

[73] Assignee: Epic Products Limited, Salford, England

[21] Appl. No.: 539,617

[22] Filed: Jun. 18, 1990

[30] Foreign Application Priority Data

Jun. 20, 1989 [GB] United Kingdom ..... 8914177

[51] Int. Cl.[5] ..... H02K 7/118; H02K 16/00

[52] U.S. Cl. ..... 310/112; 74/665 G; 417/423.6

[58] Field of Search ..... 73/863.83, 863.84, 864.34, 73/864.35; 74/665 G, 665 GA; 310/89, 91, 112, 118; 417/350, 423.6, 423.7, 423.15, 423.14

[56] References Cited

U.S. PATENT DOCUMENTS

| | | | |
|---|---|---|---|
| 1,462,658 | 7/1923 | Richardson | 74/67 |
| 3,979,652 | 9/1976 | Faxon | 310/112 |
| 4,409,504 | 10/1983 | Wilson et al. | 310/87 |
| 4,528,483 | 7/1985 | Müller | 310/112 |
| 4,628,748 | 12/1986 | Jogan et al. | 73/864.34 |
| 4,803,390 | 2/1989 | Bertram et al. | 310/112 |

*Primary Examiner*—William H. Beha, Jr.
*Assistant Examiner*—D. Rebsch
*Attorney, Agent, or Firm*—Nies, Kurz, Bergert & Tamburro

[57] ABSTRACT

A drive system for a pump/compressor which feeds a pneumatic circuit of a portable waste water sampling device, and comprising individual electric motors (20) each operating at 12 volts and drawing a current no greater the 350 mA at 2.5 w, the motors driving a common pinion (23) with an output shaft (24) for connection to the pump/compressor. The use of a number of low capacity drive motors, which together provide sufficient torque to drive the pump/compressor, avoids the danger of spark generation, particularly in a potentially explosive environment such as may be found below ground. Since the motors are small they may be mounted conveniently within the sampling equipment, taking up no more space than would be occupied by a single motor of larger capacity.

8 Claims, 2 Drawing Sheets

MULTI-MOTOR LIQUID SAMPLE AND DEVICE

This invention concerns a drive system for a pump-/compressor which in the preferred embodiment feeds a pneumatic circuit of a portable waste water sampling device.

Current legislation requires that portable sampling devices designed to be used in a potentially explosive environment which may be below ground, must comply with certain safety requirements such as those stated in BS 5501:Pt.7:1977 EN50020.

In order to comply with these safety requirements the power generated within any electrical circuit associated with the equipment must be below a certain level, thus to avoid the risk of spark generation which could lead to explosion. The power within the circuit is dependent upon the inductance, capacitance and resistance of the electric motor and its supply circuitry. Constrained by these requirements the input torque to the pump/compressor as provided by a single motor, is insufficient to meet the pressure and vacuum requirements of the sampler.

An object of the present invention is to provide a drive system for use with a sampler which meets safety standards, yet provides sufficient motive power for the sampler to operate.

According to the present invention a drive system for a pump/compressor having a predetermined input torque requirement comprises a number of electric motors, each alone being incapable of providing a sufficient level of torque, and drivingly connected in combination to said pump/compressor via a common mechanical connection.

Various embodiments of the invention will now be described, by way of example only, with reference to the accompanying schematic drawings in which:

FIG. 1 illustrates a typical pneumatic circuit with a pump/compressor and drive system, and a sampler connected to the circuit;

FIGS. *2a* and *2b* illustrate side and front elevations respectively of a first embodiment of the invention;

Figure 1:
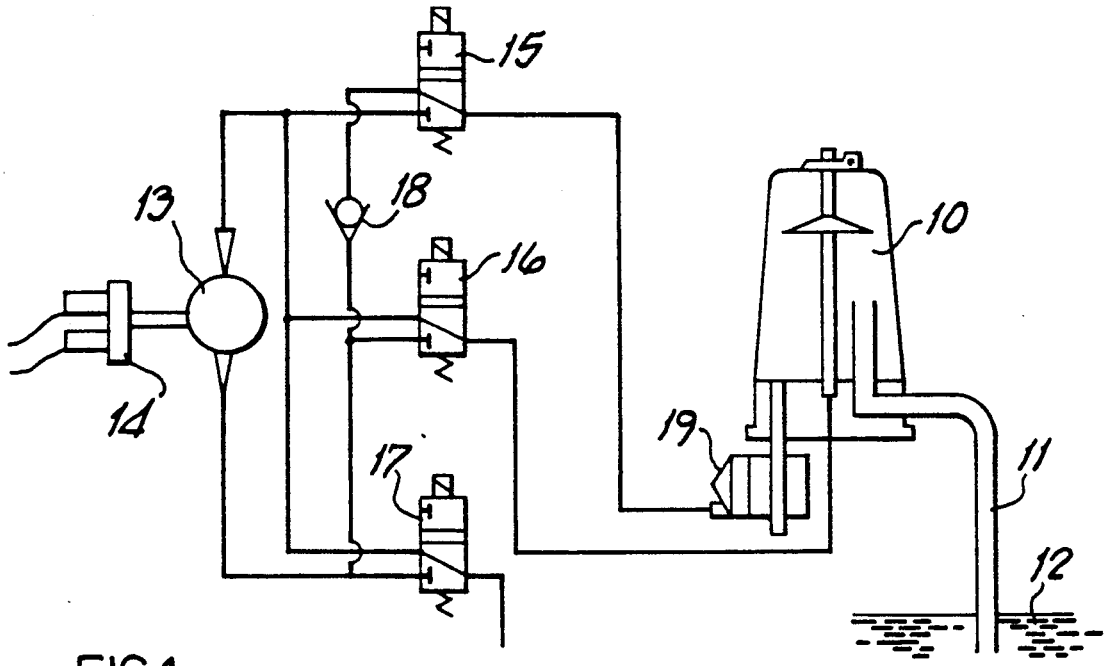
FIG.1 PRIOR ART
Figure 2A:
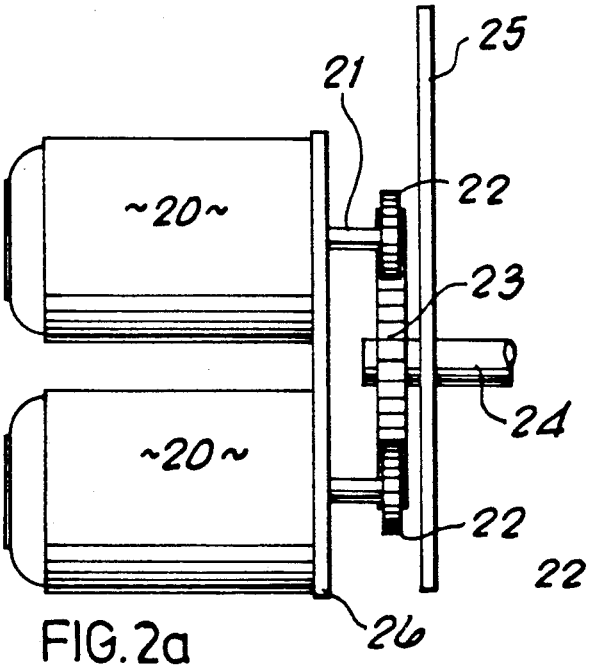
Figure 2B:
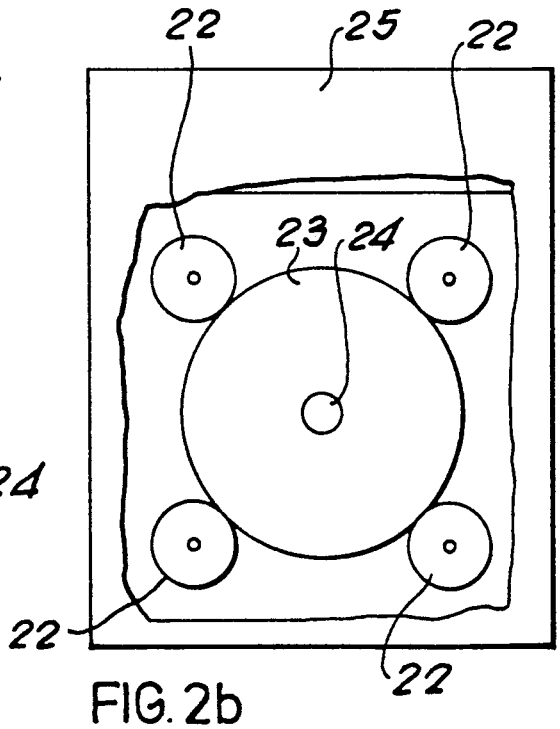

Referring now to the drawings, in FIG. 1 there is illustrated in schematic form the essential elements of a portable waste water sampler and associated pneumatic circuit. The sampler includes a sample chamber 10 with a pipe 11 which dips into liquid 12 to be sampled.

A pneumatic circuit comprises a compressor 13 driven by a drive system 14, three solonoid operated two-way valves 15, 16 and 17, a non-return valve 18 and a pinch valve 19.

The system illustrated in FIG. 1, which is known, is operated such that the compressor initially forces air outwardly through pipe 11 to expel any liquid residing in the pipe itself or in the chamber 10 and then reverses to draw liquid to be sampled into the chamber 10 so that it may be taken for analysis. Thereafter, the chamber is emptied by once again applying pressurized air thereto from the compressor 13.

To produce sufficient energy to drive the compressor a certain predetermined amount of motive power must be provided, and this is determined by the scale of the equipment and the height to which the liquid sample must be drawn. In order to comply with official safety standards when operating such a system, for example, below ground where explosive gases may be present, the drive motor 14 and its power supply circuitry must be of a sufficiently low level for there to be no danger of spark generation. A single drive motor of such low electrical characteristics would be insufficient to drive the compressor 13 for the sampler to operate.

Therefore, in accordance with the invention a plurality of motors are connected in combination to the compressor to provide the necessary motive power, but each motor is of low operating characteristics complying with the safety requirements.

Referring to FIGS. *2a* and *2b*, a drive system consists of four small electric motors 20, each operating at 12 volts and drawing a current of approximately 300 to 350mA at 2.5w. Thus each motor complies with the safety standards and drives an output shaft 21, and via individual spur gears 22, a large pinion 23 mounted on an output shaft 24 which is connected to the compressor 13 of the system.

The compressor mounting plate is shown at 25, and for convenience all four motors are mounted on a common plate 26.

Figure 3:
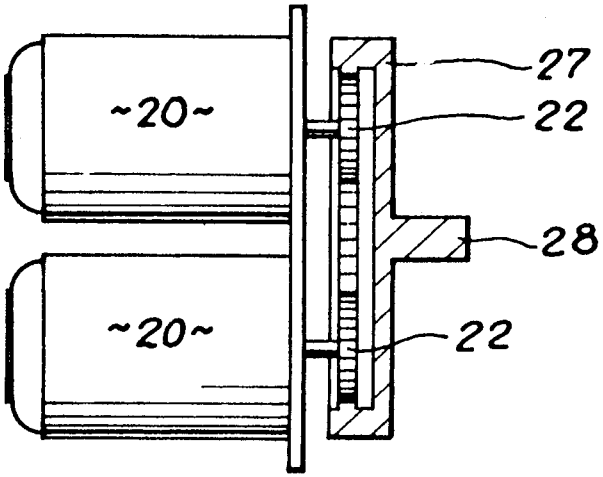
FIG. 3 is a side elevation of a further embodiment.

Referring now to FIG. 3, in a modified arrangement, the spur gears 22 are arranged to drive an internal ring gear 27 carrying an integral output shaft 28.

Figure 4:
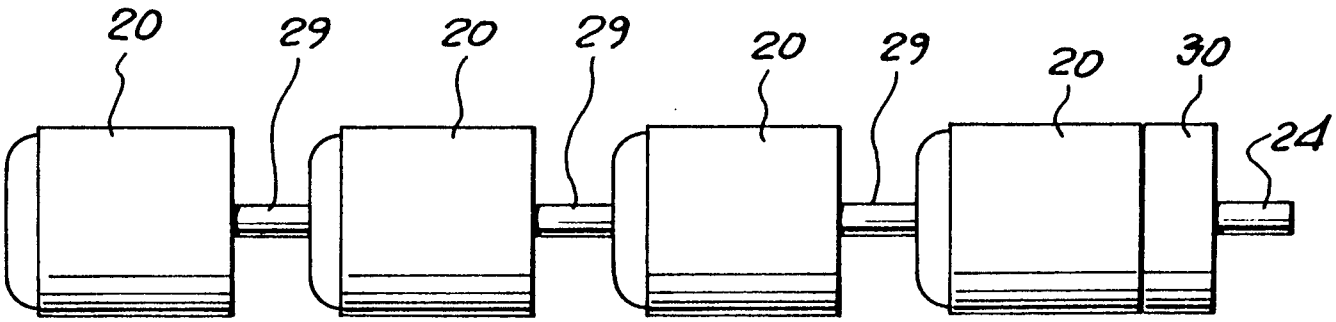
FIG. 4 is a schematic illustration of a still further embodiment.

A third embodiment is illustrated in FIG. 4 in which the four motors are mounted in line on a common shaft 29, or on separate through shafts which are interconnected, and the gear box 30 is mounted at one end of the common shaft.

Figure 5:
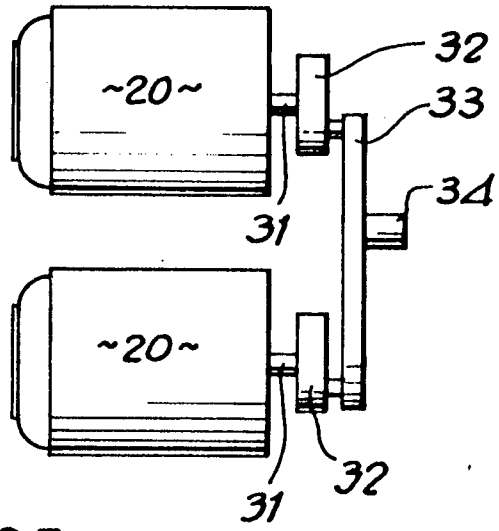
FIG. 5 is a side elevation of a fourth embodiment.

In a fourth embodiment as illustrated in FIG. 5 each motor may include within its casing an individual gear box, so that the output shafts 31 each directly drive an eccentric 32 connected by a linkage 33 to a compressor drive pin 34.

In all embodiments, the output shaft is adapted to drive the compressor with a mechanism similar to that just mentioned, i.e. including an eccentric, a linkage and a drive pin. This is the conventional way of driving a compressor.

It will be appreciated that the safety requirements are met by the use of multiple circuits and small motors to drive a single compressor via a mechanical linkage with multiple inputs and one output. The mechanical power provided by the motors in combination is sufficient to drive a compressor. Since the motors are physically small they may be mounted conveniently within the sampling equipment, taking up no more space than would be occupied by a single motor of a larger capacity.

What is claimed is:

1. A liquid sampler comprising a sample chamber or collection vessel, a pipe communicating with the chamber or vessel by which liquid may be drawn into and discharged from same, a pump or compressor for drawing or discharging the liquid, and a drive system for driving the pump or compressor, characterized in that the drive system comprises a plurality of electric motors, each alone being incapable of providing sufficient torque to drive said pump or compressor, and drivingly connected in combination to the pump or compressor via a common mechanical connection, and in that multiple power supply circuits are provided, one for each electric motor.

2. A liquid sampler according to claim 1, wherein said common mechanical connection comprises a plurality of driven inputs and a single driven output.

3. A liquid sampler according to claim 1, including four electric motors supported on a common mounting plate each operating at 12 volts and drawing a current of no greater than 350mA at 2.5w.

4. A liquid sampler according to claim 1, wherein each said electric motor drives an output shaft connected, via an individual spur gear, to a common pinion mounted on a common output shaft drivingly connected to the pump or compressor.

5. A liquid sampler according to claim 4, wherein the spur gears are adapted to drive an internal ring gear carrying said common output shaft for the pump or compressor.

6. A liquid sampler according to claim 1, wherein said plurality of electric motors are mounted in line on a common shaft or composite shaft.

7. A liquid sampler according to claim 6, wherein said common shaft or composite shaft is drivingly connected to a gear box whose output shaft is connected to the pump or compressor.

8. A liquid sampler according to claim 1, wherein each said electric motor includes an individual gear box, the output shafts of the motors being drivingly connected directly to a common mechanical connection comprising an eccentric, a linkage and a compressor drive bin.

* * * * *

UNITED STATES PATENT AND TRADEMARK OFFICE

CERTIFICATE OF CORRECTION

PATENT NO. : 5,043,617

DATED : August 27, 1991

INVENTOR(S) : Joseph A. Rostron

It is certified that error appears in the above-identified patent and that said Letters Patent is hereby corrected as shown below:

On the title page, item (54) should read --Multi-Motor Liquid Sampler Device--.

Signed and Sealed this

Fourth Day of May, 1993

*Attest:*

Michael K. Kirk

MICHAEL K. KIRK

*Attesting Officer*

*Acting Commissioner of Patents and Trademarks*